US005259206A

United States Patent [19]

Dankowski

[11] Patent Number: 5,259,206

[45] Date of Patent: Nov. 9, 1993

[54] COMPACT CONDENSER

[75] Inventor: Gerhard Dankowski, Royse City, Tex.

[73] Assignee: Danhard, Inc., Dallas, Tex.

[21] Appl. No.: 25,087

[22] Filed: Mar. 2, 1993

Related U.S. Application Data

[63] Continuation of Ser. No. 802,531, Dec. 5, 1991, abandoned.

[51] Int. Cl.[5] ..... F25B 39/04

[52] U.S. Cl. ..... 62/507; 165/122

[58] Field of Search ..... 62/506, 507, 508; 165/121, 122

[56] References Cited

U.S. PATENT DOCUMENTS 3,138,941 6/1964 Jensen ..... 62/184

4,510,991 4/1985 Kawahira ..... 165/41

*Primary Examiner*—Ronald C. Capossela

*Attorney, Agent, or Firm*—Richards, Medlock & Andrews

[57] ABSTRACT

A compact condenser system has a compact arrangement that also increases the efficiency of the condenser. The compact condenser comprises two heat exchangers fixed opposite each other on a frame and at least one fan is interposed between the heat exchangers so as to draw air through the second heat exchanger and push air through the first heat exchanger while refrigerant flows from the first heat exchanger to the second heat exchanger. Liquefaction of the refrigerant with two opposed heat exchangers increases the efficiency and compactness of the condenser.

10 Claims, 2 Drawing Sheets

COMPACT CONDENSER

RELATED APPLICATION

This is a continuation of my copending application Ser. No. 07/802,531, filed Dec. 5, 1991 now abandoned.

TECHNICAL FIELD OF THE INVENTION

This invention relates to a condenser for liquefying a vapor refrigerant received from a compressor. In one aspect, this invention relates to such a condenser with a compact arrangement and increased efficiencies that is suitable for use in vehicles.

BACKGROUND OF THE INVENTION

Present air conditioner condensers typically comprise one heat exchanger. Vapor refrigerant is driven by a compressor through the tubes of the heat exchanger while air is passed across the tubes to facilitate removal of the heat from the vapor refrigerant. Usually there are four to six rows of tubes. There is approximately a 20 percent loss in efficiency of heat transfer with each successive row of tubes. As the vapor refrigerant starts to liquefy in the exchanger, the temperature differential between the refrigerant and the air decreases which decreases the rate of heat transfer. Accordingly, heat exchangers take up considerable space to accommodate the needed lengths of the rows of tubes to insure liquefaction of the refrigerant. The large size of the heat exchanger presents problems in placing the condenser in limited spaces available in various vehicles. Also, as the space inside the vehicle that needs to be cooled increases, such as in buses or other larger vehicles, the size of condensers must increase which in turn compounds the problem of fitting the condenser in the vehicle.

Thus a need exists for a more compact condenser design that also increases the efficiency of heat transfer out of the refrigerant with each successive row of tubes.

SUMMARY OF THE INVENTION

The present invention provides a compact condenser for use in the air conditioning system of a vehicle. The compact condenser comprises a first heat exchanger and a second heat exchanger fixed opposite each other in a frame such that there is a space between the first and second heat exchangers. At least one fan is interposed in the space between the first and second heat exchanger such that air is drawn through the second heat exchanger and pushed through the first heat exchanger. The heat exchangers have a plurality of tubes for passage of refrigerant through the heat exchangers. Vapor refrigerant enters the first heat exchanger and exits partially liquefied. The partially liquefied refrigerant then enters the second heat exchanger where it exits substantially liquefied and ready for delivery to an evaporator.

Use of two heat exchangers in such an arrangement provides two smaller heat exchangers instead of one large one. The position of the two smaller heat exchangers relative to each other can be varied to facilitate fitting the compact condenser in limited and cramped areas. Stepping the heat transfer into two heat exchangers contributes to efficiency increases of up to 15% depending on the circumstances.

Therefore, the present invention provides a compact condenser design which is more readily fitted within the limited space of vehicles. Moreover, the present invention is to provide a condenser with increased efficiency.

BRIEF DESCRIPTION OF THE DRAWINGS

For a more complete understanding of the present invention and for further advantages thereof, reference is now made to the following Detailed Description of the invention taken in conjunction with the accompanying drawings in which.

DETAILED DESCRIPTION

Figure 1:
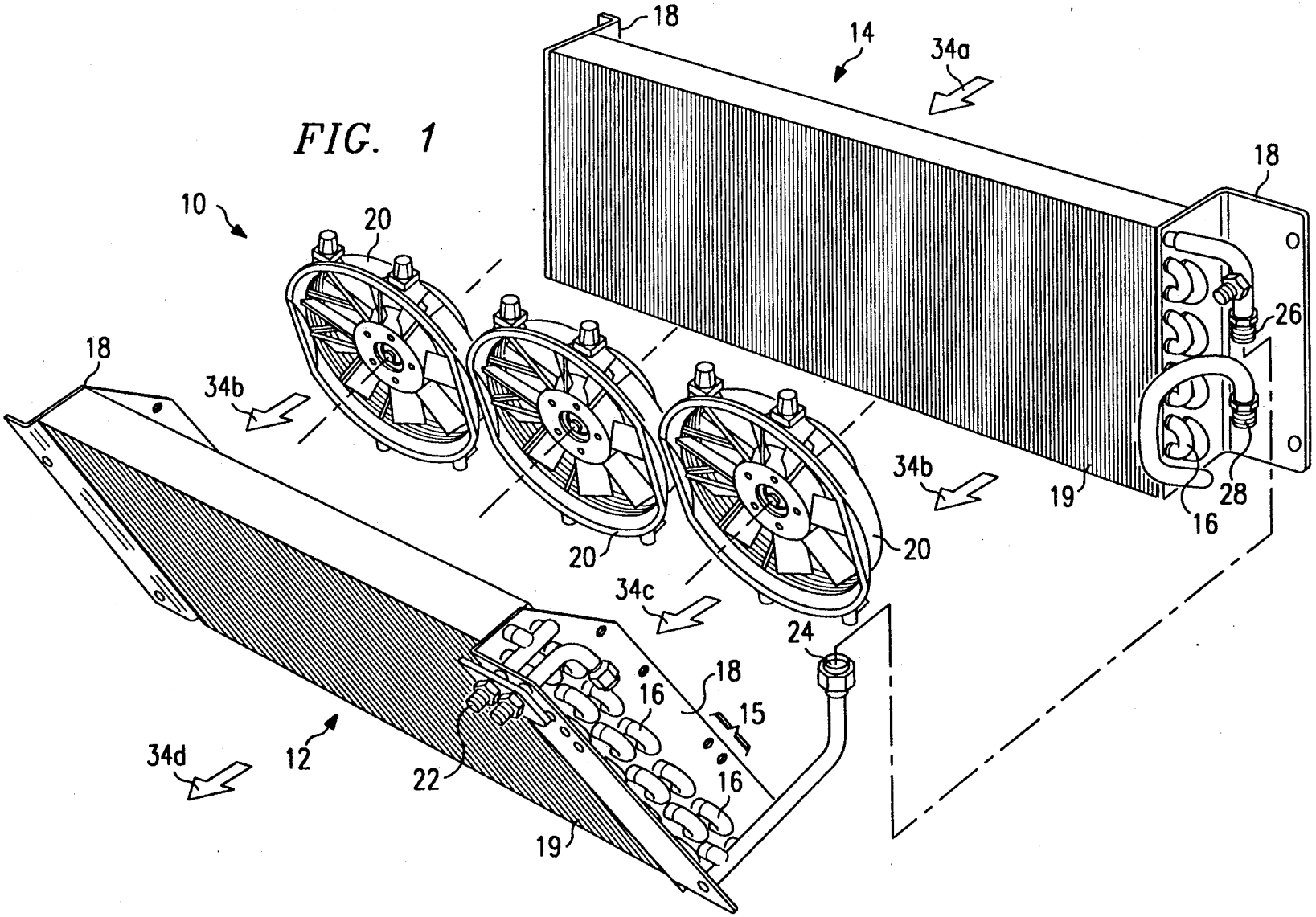
FIG. 1 is an exploded perspective of the preferred embodiment of the compact condenser of the present invention.
Figure 2:
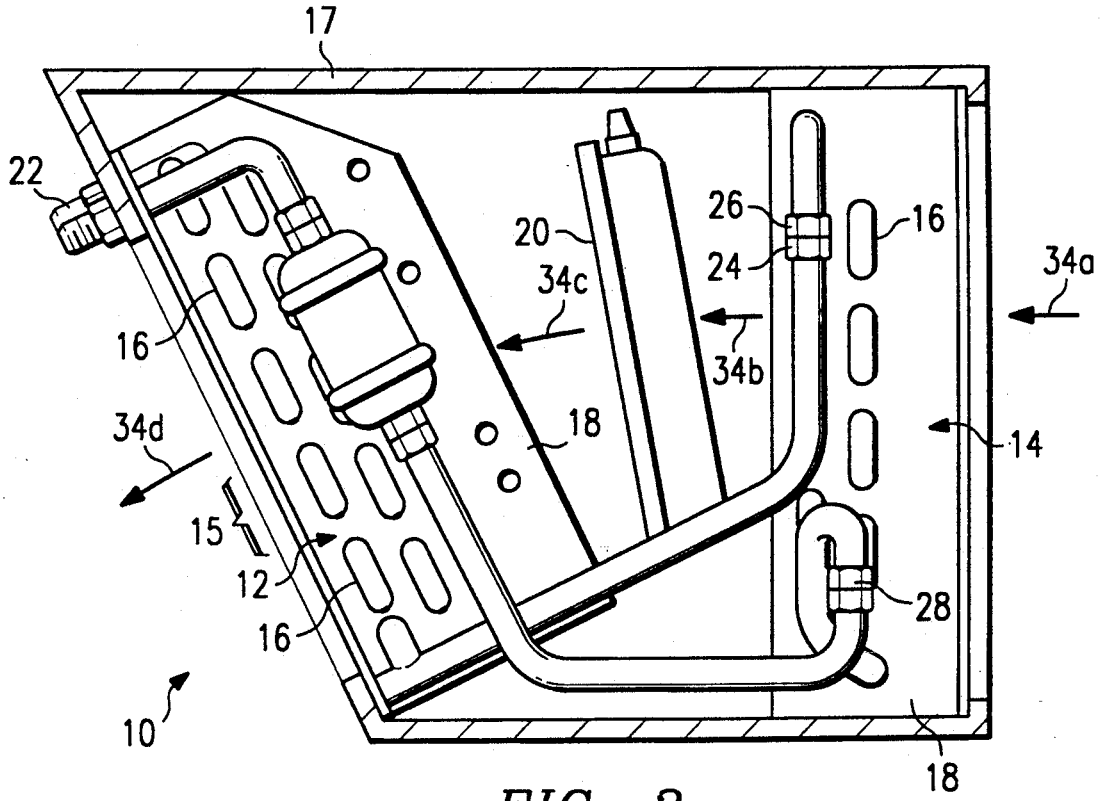
FIG. 2 is a side view of the preferred embodiment of the compact condenser of the present invention in its assembled state.

Referring to FIGS. 1 and 2, reference numeral 10 generally identifies the compact condenser of the present invention used in conjunction with an air conditioning system for motor vehicles. Compact condenser 10 comprises first heat exchanger 12 and second heat exchanger 14 fixed opposite each other with three fans 20 interposed between the exchangers. The vapor refrigerant from a compressor enters first heat exchanger 12 at vapor refrigerant entrance nozzle 22 of tube 16 for flow therethrough. Tubes 16 are arranged in tube rows 15 which run through the first heat exchanger 12. Vapor refrigerant travels through tube rows 15 in first heat exchanger 12 while air is pushed through first heat exchanger 12 by fans 20. As heat is transferred from the refrigerant, the refrigerant begins to liquefy. Partially liquefied refrigerant exits the first heat exchanger at partially liquefied refrigerant exit nozzle 24. The partially liquefied refrigerant then enters into second heat exchanger 14 at partially liquefied refrigerant entrance nozzle 26. Partially liquefied refrigerant flows through tube rows 15 in second heat exchanger 14 while air is drawn through second heat exchanger 14 by fans 20 until the refrigerant is substantially liquefied and exits at liquefied refrigerant exit nozzle 28. The present condenser is designed for use in a conventional air conditioner assembly wherein the refrigerant, upon exiting liquefied refrigerant exit nozzle 28, is delivered through an expansion valve and into an evaporator where it will eventually be compressed again by a compressor to enter first heat exchanger 12 again at vapor refrigerant entrance nozzle 22.

The design and construction of heat exchangers 12 and 14 is of a conventional design where tube rows 15 are supported in end plates 18 and disposed through and in contact with a plurality of heat transfer fins 19.

With reference to FIG. 1, direction arrows **34*a*, 34*b*, 34*c* and 34*d* indicate travel of air through compact condenser 10. Direction arrow 34*a* indicates ambient air being drawn towards second heat exchanger 14 where it will complete the process of liquefying the refrigerant in second heat exchanger 14. The air indicated at direction arrows 34*b* has been drawn through second heat exchanger 14 and is being pushed towards first heat exchanger 12. The air at this stage is hotter than the ambient air at direction arrow 34*a*, however, since the temperature of the vapor refrigerant in first heat exchanger 12 is so high, there is sufficient temperature differential between the vapor refrigerant at first heat exchanger 12 and the air at direction arrow 34*b* to sufficiently liquefy the vapor refrigerant travelling through first heat exchanger 12. The air at direction arrow 34*c*** has been drawn into fans 20 and is being pushed towards first heat exchanger 12. The air indicated at direction arrow 34*d* has finished passing through first heat exchanger 12. This preferred arrangement of compact condenser 10 provides a compact design which is highly desirable in order to save space in vehicles. Also, it has been found that separating the liquefaction process into two different heat exchangers generates greater efficiencies of up to 15 percent depending on the circumstances.

Alternatively, more than two heat exchangers can be used. A plurality of heat exchangers can be situated so that a single current of air can be directed through the heat exchangers in a direction counter to the progression of refrigerant through the heat exchangers. The direction arrows 34*a*, 34*b*, 34*c* and 34*d* indicate such a current. As the air current proceeds through the heat exchangers, the temperature of the air increases. This counter direction of the air insures a sufficient temperature differential between the air and refrigerant at each heat exchanger. If the air were directed in the direction of the progression of refrigerant through the heat exchanger, the temperature differential would decrease rendering downstream heat exchangers ineffective.

The heat exchangers can be tilted at various angles to each other to facilitate placement of the condenser in a compact area of a vehicle. Thus the present invention provides a compact condenser which can be arranged according to the space available for the condenser. In FIGS. 1 and 2, first heat exchanger 12 is tilted with respect to second heat exchanger 14. With reference to FIG. 2, the heat exchangers are fixed relative to each other by being mounted on frame 17. Frame 17 can be modified to fit into the available space.

Although the present invention has been described with respect to a specific preferred embodiment thereof, various changes and modifications may be suggested to one skilled in the art, and it is intended that the present invention encompass such changes and modifications as fall within the scope of the appended claims.

I claim:

1. A heat exchange system comprising:

a first heat exchanger and a second heat exchanger fixed in an opposed relationship such that air flow through the heat exchangers first flows through one of the heat exchangers and thereafter through the other of the heat exchangers, said first and second heat exchangers having a continuous fluid flow tube therethrough for the travel of heat exchange fluid first through one of said heat exchangers and thereafter through the other of said heat exchangers, said heat exchangers having an air space therebetween;

a fan positioned in the air space between said first and second heat exchangers;

means for rotating said fan such that air is first drawn through said second heat exchanger and thereafter pushed through said first heat exchanger; and means for pumping heat exchange fluid through said continuous fluid flow tube so that the heat exchange fluid flows first through said first heat exchanger and thereafter through said second heat exchanger.

2. A heat exchange system in accordance with claim 1, wherein said first heat exchanger receives vapor refrigerant from a compressor, and wherein the vapor refrigerant is partially liquefied in said first heat exchanger when said fan pushes air through said first heat exchanger.

3. A heat exchange system in accordance with claim 2, wherein said second heat exchanger receives the partially liquefied refrigerant from said first heat exchanger, and wherein the thus received partially liquefied refrigerant is substantially liquefied in said second heat exchanger when said fan draws air through said second heat exchanger.

4. A heat exchange system in accordance with claim 1, wherein one of said heat exchangers is positioned at an angle relative to the other of said heat exchangers to make the dimension of the space occupied by said heat exchangers wider at one edge of the heat exchangers than at an opposite edge.

5. A heat exchange assembly comprising:

a frame;

a first heat exchanger mounted on said frame, said first heat exchanger having a first passage for receiving refrigerant at a high temperature from a compressor, said first heat exchanger being capable of removing heat from the thus received refrigerant so that the refrigerant exits said first heat exchanger at an intermediate temperature which is lower than said high temperature;

a second heat exchanger mounted on said frame, said second heat exchanger having a second passage for receiving the refrigerant from the first heat exchanger at the intermediate temperature, said second heat exchanger being capable of removing heat from the refrigerant in said second passage so that the refrigerant exits said second heat exchanger at a low temperature which is lower than said intermediate temperature; and a fan mounted on said frame at a location between said first heat exchanger and said second heat exchanger and oriented for creating a flow of air that travels first through said second heat exchanger and then through said first heat exchanger such that the air flowing through said second heat exchanger is at a lower temperature than the air flowing through said first heat exchanger.

6. A condenser assembly for use in a vehicle, said assembly comprising:

a first heat exchanger for receiving refrigerant from a compressor;

a second heat exchanger for receiving the refrigerant as it is discharged from said first heat exchanger; and a fan for creating an air current, said fan being located between said first and second heat exchangers;

said first heat exchanger being fixed relative to said fan and positioned in the air current; and said second heat exchanger being fixed relative to said fan and positioned in the air current upstream from said first heat exchanger.

7. A condenser assembly in accordance with claim 6, wherein said fan is mounted to at least one of said first and second heat exchangers.

8. A condenser assembly in accordance with claim 6, further comprising a frame on which said first and second heat exchangers are mounted.

9. A condenser assembly in accordance with claim 8, wherein said fan is mounted to at least one of said first and second heat exchangers.

10. A condenser system for removing heat from a refrigerant, said condenser system comprising:

a plurality of heat exchangers connected in series such that refrigerant enters a first one of said heat exchangers at a high temperature, flows successively through each of said plurality of heat exchangers and then exits the last heat exchanger at a lower temperature, said plurality of heat exchangers being arranged such that air can be moved successively through each of said plurality of heat exchangers in a direction opposite to the progression of the refrigerant through said plurality of heat exchangers; and a fan positioned in-between two of said heat exchangers to move air through said plurality of heat exchangers opposite the direction of movement of the refrigerant through said plurality of heat exchangers.

* * * * *